US005607058A

United States Patent [19]

Huesman et al.

[11] Patent Number: 5,607,058

[45] Date of Patent: Mar. 4, 1997

[54] TWO-CELL WINDOWED CARTON

[75] Inventors: Joseph A. Huesman, Hamilton Township; Gene M. Altonen, West Chester, both of Ohio

[73] Assignee: The Procter & Gamble Company, Cincinnati, Ohio

[21] Appl. No.: 355,784

[22] Filed: Dec. 14, 1994

[51] Int. Cl.[6] ..... B65D 5/486

[52] U.S. Cl. ..... 206/581; 206/77.1; 206/823; 229/120.15; 229/162

[58] Field of Search ..... 206/45.14, 45.31, 206/45.33, 45.34, 77.1, 526, 581, 823; 229/120.14, 120.15, 162

[56] References Cited

U.S. PATENT DOCUMENTS

| | | | |
|---|---|---|---|
| 2,162,089 | 6/1939 | Kagen | 229/9 |
| 2,523,415 | 9/1950 | Bowers | 206/46 |
| 2,643,811 | 6/1953 | Bolding | 229/27 |
| 2,807,404 | 9/1957 | Cote | 229/27 |
| 2,913,101 | 11/1959 | Daily | 206/45.19 |
| 3,185,048 | 5/1965 | Struble | 93/37 |
| 3,233,726 | 2/1966 | Gero | 206/45.31 |
| 3,235,163 | 2/1966 | Hennessey | 229/37 |
| 3,347,356 | 10/1967 | Kossnar | 206/45.29 |
| 3,446,414 | 5/1969 | Omori | 229/120.15 |
| 3,780,931 | 12/1973 | Hanson | 229/27 |

(List continued on next page.)

FOREIGN PATENT DOCUMENTS 2617128 12/1988 France .

OTHER PUBLICATIONS

Lever Brothers Company, Dove Moisturizing Body Wash Carton photographs (Figures 1 through 6) To the best of the knowledge of individuals associated with this patent application, Sep. 1994 was the earliest date that this carton was known by The Procter & Gamble Company.

The Dyment Company, Dyment Company Prototype Carton photographs (Figures 1 through 4) To the best of the knowledge of individuals associated with this patent application, Jul. 1993 was the earliest date that this carton was known by The Procter & Gamble Company.

*Primary Examiner*—Jimmy G. Foster
*Attorney, Agent, or Firm*—Michael E. Hilton; Daniel F. Nesbitt; Michael J. D'Amelio

[57] ABSTRACT

A two-cell windowed carton is provided for displaying a pair of disparate articles in side by side relation which is formed from a one piece blank of cartonboard. The display carton has opposing front and back walls, opposing top and bottom walls, and opposing first and second side walls. These walls are connected forming a box. Only the opposing top and bottom walls have a double thickness of cartonboard. The front wall has a compartment dividing wall foldably connected thereto. The compartment dividing wall extends inwardly from the front wall to a compartment wall support. The compartment dividing wall separates a first article cell from a second article cell. The first article cell has an opening in the front wall and also has a back intermediate wall. The back intermediate wall is spaced inwardly from and parallel to the back wall by a compartment wall support. The back intermediate wall extends between the first side wall and the compartment dividing wall. The second article cell is provided with an aperture having a transparent plastic film covering the aperture forming an article display window. The article display window enables a consumer to view the article contained within the second article cell. A first article cell has a circumference defined by the circumference of the first side wall, the front wall, the compartment dividing wall, and the back intermediate wall. The first article cell has a height, a width, and a depth substantially equivalent to the height, width and depth of the first article which is contained in the first article cell. A second article cell for containing a second article has a circumference defined by the second side wall, the back wall, the compartment wall support, the compartment dividing wall, and the front wall. The second article is compressible and is maintained in a compressed state by the second article cell.

14 Claims, 6 Drawing Sheets

U.S. PATENT DOCUMENTS

| | | | |
|---|---|---|---|
| 3,804,321 | 4/1974 | Forbes, Jr. | 229/38 |
| 3,845,898 | 11/1974 | Hackenberg | 229/28 R |
| 4,105,154 | 8/1978 | Meyers et al. | 229/27 |
| 4,125,185 | 11/1978 | Bliss | 206/45.15 |
| 4,342,417 | 8/1982 | Forbes, Jr. | 229/27 |
| 4,487,311 | 12/1984 | Lavery | 206/45.31 |
| 5,242,107 | 9/1993 | De Nola | 229/120.26 |
| 5,284,291 | 2/1994 | Sellors | 229/120.03 |
| 5,465,834 | 11/1995 | Sieber et al. | 206/193 |

TWO-CELL WINDOWED CARTON

FIELD OF THE INVENTION

The present invention relates to cartonboard cartons with window portions for viewing of the contents contained therein; and more particularly, to such cartons having two compartments.

BACKGROUND OF THE INVENTION

When a pair of disparate articles, which are often of different size, shape and material, are unitized some difficulty is generally experienced in properly supporting and handling these articles such that they remain in their proper positions within a carton during transit. It is also desirable to display internal articles using display windows. Properly positioning the article is a particular concern when utilizing such windowed display type cartons. Therefore, in the shipment of display cartons containing disparate articles, such as a bottle along with another type of article, it is highly desirable to provide a means for holding these articles so that they will not move around since movement prevents the articles from being properly displayed to the consumer.

The ability to shelve, ship, and store two articles contained in one carton as well as display these articles to the consuming public have long been important goals of those skilled in the art. Thus, a variety of two compartment windowed cartons have been available for many years. One way to display two articles in a single carton is to use a knock-in panel type carton. Generally these cartons have panels that fold inwardly forming a rectangular cell between the folded panels and the walls from which they are cut. Typically these cartons are such that a film can not cover the opening created by the knock-in panel. Existing cartons of this type, however, suffer from at least one major drawback when used to hold a compressed article. For example, when an article has been compressed prior to placement into a carton of this type it will expand and protrude out of the windowed openings. This type carton allows the article to become dirty since it is exposed to the external environment. Problems may also occur when attempting to closely stack adjacent cartons since, as indicated above, a carton having an article that protrudes outside of its walls takes up valuable shelf and shipping space.

An additional disadvantage generally encountered in existing dual compartment display cartons is double walls. While some cartons have addressed the need for a dual display windowed arrangement having one display window open and the other display window sealed, most do so in an inefficient manner. One example of such a carton is seen in U.S. Pat. No. 4,487,311 issued to Lavery on Dec. 11, 1984. Such cartons of this type utilize cartonboard material to form multiple double thickness vertical walls. Doubling the thickness of a wall increases the amount of material used to construct the wall and also increases the overall cost of the carton. Of course, the use of such double walls results in environmental and financial costs.

The less material used in construction of a package the less material the consumer must dispose of after using the article contained in the package. Reducing the amount of material used in construction of a carton not only reduces the amount of waste but also has the added benefit of reducing the overall cost of the carton. Thus, there is a need to eliminate any overlapping and double thickness walls that might be formed during carton construction. Reductions in carton sizing has also been driven by an effort to maximize the amount of product that can be shipped and displayed without increasing the amount of shelf space required to store the product. Thus, reduction of carton sizing and the amount of material used to make cartons are important concerns of those skilled in the art.

SUMMARY OF THE INVENTION

In one aspect of the present invention, a two-cell windowed carton is provided for displaying a pair of disparate articles in side by side relation which is formed from a one piece blank of cartonboard. The display carton has opposing front and back walls, opposing top and bottom walls, and opposing first and second side walls. These walls are connected forming a box. Only the opposing top and bottom walls have a double thickness of cartonboard. The front wall has a compartment dividing wall foldably connected thereto. The compartment dividing wall extends inwardly from the front wall to a compartment wall support. The compartment dividing wall separates a first article cell from a second article cell. The first article cell has an opening in the front wall and also has a back intermediate wall. The back intermediate wall is spaced inwardly from and parallel to the back wall by a compartment wall support. The back intermediate wall extends between the first side wall and the compartment dividing wall. The second article cell is provided with an aperture having a transparent plastic film covering the aperture forming an article display window. The article display window enables a consumer to view the article contained within the second article cell.

In a second aspect of the present invention a display carton is formed from a one piece blank of cartonboard and contains two disparate articles in side by side relation. The display carton has opposing front and back walls, opposing top and bottom walls, and opposing first and second side walls. These walls are connected forming a box. Only the opposing top and bottom walls have a double thickness of cartonboard. The first article cell has a circumference defined by the first side wall, the front wall, the compartment dividing wall, and the back intermediate wall. The front wall having the compartment dividing wall foldably connected thereto and extending inwardly from the front wall to the back intermediate wall. The back intermediate wall is spaced inwardly from and parallel to the back wall by a compartment wall support. The first article cell has a height, a width, and a depth substantially equivalent to the height, width, and depth of the first article which is contained in the first article cell. The first article cell having an opening in the front wall. A second article cell for containing a second article. The second article cell has a circumference defined by the second side wall, the back wall, the compartment wall support, the compartment dividing wall, and the front wall. The second article cell is provided with an aperture having a transparent plastic film covering the aperture forming an article display window. The article display window enabling a consumer to view the second article contained within the second article cell. The second article, contained in the second article cell, is compressible and is maintained in a compressed state by the second article cell.

BRIEF DESCRIPTION OF THE DRAWINGS

While the specification concludes with claims which particularly point out and distinctly claim the invention, it is believed that the present invention will be better understood from the following description taken in conjunction with the appended claims and the accompanying drawings, in which like reference numerals identify identical elements and wherein;

DETAILED DESCRIPTION OF THE INVENTION

Figure 1:
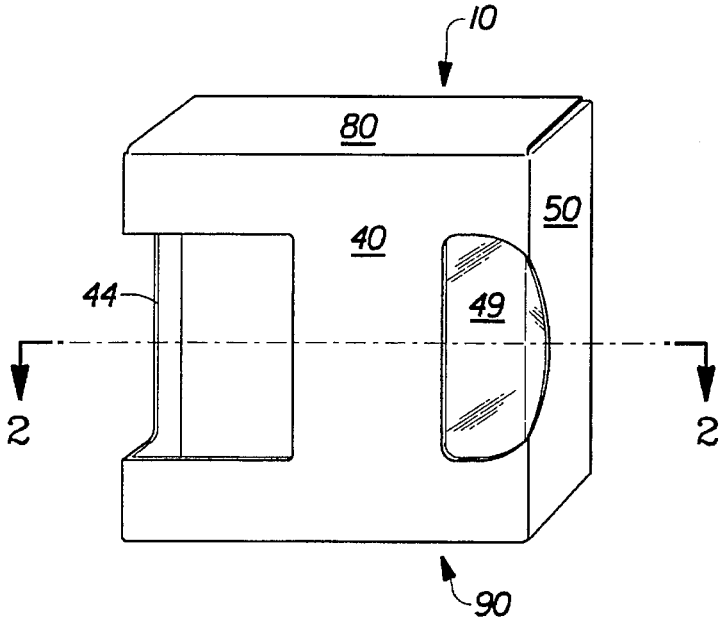
FIG. 1 is a perspective view of a preferred embodiment of the present invention, without showing the articles contained therein and prior to opening.
Figure 2:
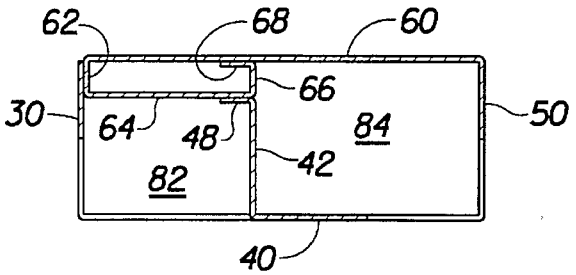
FIG. 2 is a cross-sectional view taken along line 2—2 of FIG. 1.
Figure 5:
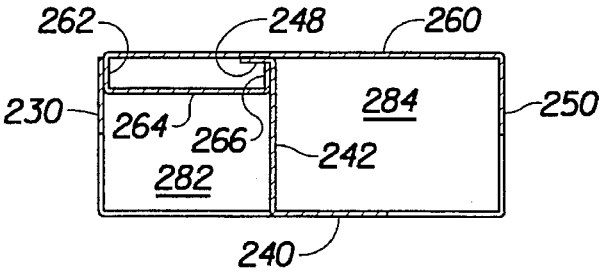
FIG. 5 is a cross-sectional view taken along line 5—5 of FIG. 8 showing the compartment wall support of a second embodiment of the present invention.
Figure 3:
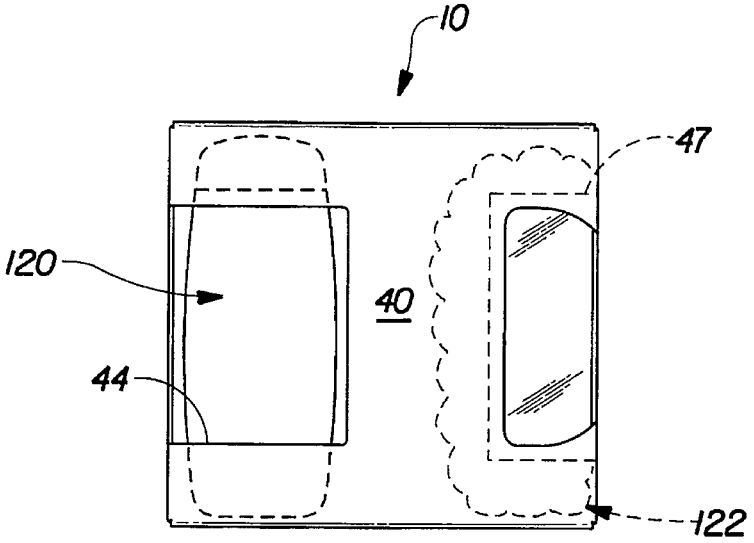
FIG. 3 is a front elevation view of a preferred embodiment of the present invention showing the articles contained therein, prior to opening.

In a particularly preferred embodiment seen in FIG. 1, the present invention provides a cost effective two-cell windowed carton, indicated generally as 10, that minimizes cartonboard material usage. This display carton 10 which is formed from a one piece blank 20 is made for containing two disparate articles 120 and 122 in side by side relation. This carton 10 is shown in FIGS. 1–3. The carton 10 has opposing front and back walls 40 and 60, opposing top and bottom walls 80 and 90, and opposing first and second side walls 30 and 50. These walls 30, 40, 50, 60, 80, and 90 are connected forming a box. In FIG. 1 this carton 10 is shown in its upright position with the bottom wall 90 downward and the top wall 80 upward. The height of the carton 10 is measured in the direction of a vertical line extending from the bottom wall 90 to the top wall 80. This direction shall be called the axial direction. The width of the carton 10 is measured in the direction of a horizontal line extending from the first side wall 30 to the second side wall 50. This direction shall be called the transverse direction. The depth of the carton 10 is measured in the direction of a line extending from the front wall 40 to the back wall 60. The height, width, and depth along with the axial and transverse directions are given for the purposes of assisting the reader in understanding the invention disclosed herein.

Referring to FIG. 2 a cross sectional plan view of the carton 10 is shown. The carton 10 is divided into two separate article cells 82 and 84 by a compartment dividing wall 42. The compartment dividing wall 42 separates a first article cell 82 from the second article cell 84. A first article cell 82 has a circumference defined by four walls. The four walls that define the circumference of the first article cell 82 are the first side wall 30, the front wall 40, the compartment dividing wall 42, and the back intermediate wall 64. The first article cell 82 has a height, a width, and a depth substantially equivalent to the height, width and depth of the first article 120 which is contained in the first article cell 82. This helps to prevent damaging movement and also avoids misalignment of articles with the display window. The first article cell 82 has an opening 44 in the front wall 40. The back intermediate wall 64 is spaced inwardly from and parallel to the back wall 60 by a compartment wall support 66. The back intermediate wall 64 preferably has a height substantially equivalent to the first article 120 and the back intermediate wall 64 has a height substantially equivalent to the height of the first article cell 82. In the illustrated embodiment the compartment dividing wall 42 is foldably connected to the front wall 40 at transverse score line 45. The compartment dividing wall 42 is oriented such that it is extending inwardly from and perpendicular to the front wall 40 to the back intermediate wall 64.

A second article cell 84 for containing a second article 122 has a circumference defined by five walls. The five walls that define the circumference of the second article cell 84 are the second side wall 50, the back wall 60, the compartment wall support 66, the compartment dividing wall 42, and the front wall 40. These walls could be straight extensions of other walls, for example, see the compartment dividing wall 242 of the second embodiment in which the compartment dividing wall 242 connects directly to the back wall 260 and the compartment dividing wall 242 includes the portion extending between the front wall 240 and the back intermediate wall 264 and also includes the portion extending between the back intermediate wall 264 and the back wall 260. The portion of the compartment dividing wall 242 extending between the front wall 240 and the back intermediate wall 264 is the equivalent of compartment dividing wall 42. The portion of the compartment dividing wall 242 extending between the back intermediate wall 264 and the back wall 260 is the equivalent of compartment wall support 66. The second article cell 84 is also provided with an aperture 46. The aperture 46 highly preferably has a transparent plastic film 47 covering the aperture 46 forming an article display window 49. The article display window 49 is for enabling a consumer to view the second article 122 contained within the second article cell 84. In the illustrated embodiment the display window 49 extends to two sides of the second article cell 84 with the aperture 46 being in both the front wall 40 and the second side wall 50. The transparent plastic film 47 helps protect the contents of the second article cell 84 from dirt and other foreign objects. The transparent plastic film 47 is adhered to an interior surface of the second article cell 84 around the periphery of the aperture 46. The second article cell 84 encloses the article 122 contained therein such that external contaminates can not contaminate the article 122. The compartment dividing wall 42 and the back intermediate wall 64 are interior walls and can be used to vary the size of the article cells 82 and 84 without changing the outer dimensions of the carton 10. Preferably the second article cell 84 is larger than the first article cell 82.

Referring to FIG. 3 the display carton 10 is shown for displaying two articles 120 and 122. The first article cell 82 contains a first article 120 wherein the first article 120 contained in the first article cell 82 is capable of protecting the item or items contained within the first article 120 itself. The first article 120 has a height, a width, and a depth substantially equivalent to the height, width and depth of the first article cell 82. For example, the width of the first article 120 is greater than the compartment dividing wall 42 axial dimension and less than the back intermediate wall 64 axial dimension wherein the depth of the first article 120 is less than the axial dimension of the compartment dividing wall 42. This configuration of the first article cell 82 helps to eliminate movement of the article 120 after placement into the first article cell 82. The first article 120 typically does not require protection from dirt and contaminates. Preferably, the first article 120 is substantially non compressible, for example, a bottle, container, can, dispenser, or other similar article. More preferably, the first article 120 is a plastic bottle for a cleansing product. Even more preferably, the first article 120 is a dispensing bottle containing a liquid cleanser (may include other beneficial effects such as moisturizing or exfoliation) for personal use.

The second article cell 84 contains a second article 122. Preferably, the second article 122 is a resilient compressible type article. A resilient compressible type article, meaning for example, that it may be compressed when squeezed by hand but will return to its original shape when released. More preferably, the second article 122 is a cleansing implement, for example, a sponge, cleaning pad, or wash cloth. Even more preferably, the second article 122 is a personal cleansing implement such as a polymeric mesh sponge that is effective to clean but not effective to cause damage or injury to the skin. In the illustrated embodiment the second article 122 is compressed prior to insertion into the second article cell 84 and is maintained in a compressed state by the second article cell 84 even when the second article 122 expands to fill the second article cell 84 after being inserted therein.

Figure 4:
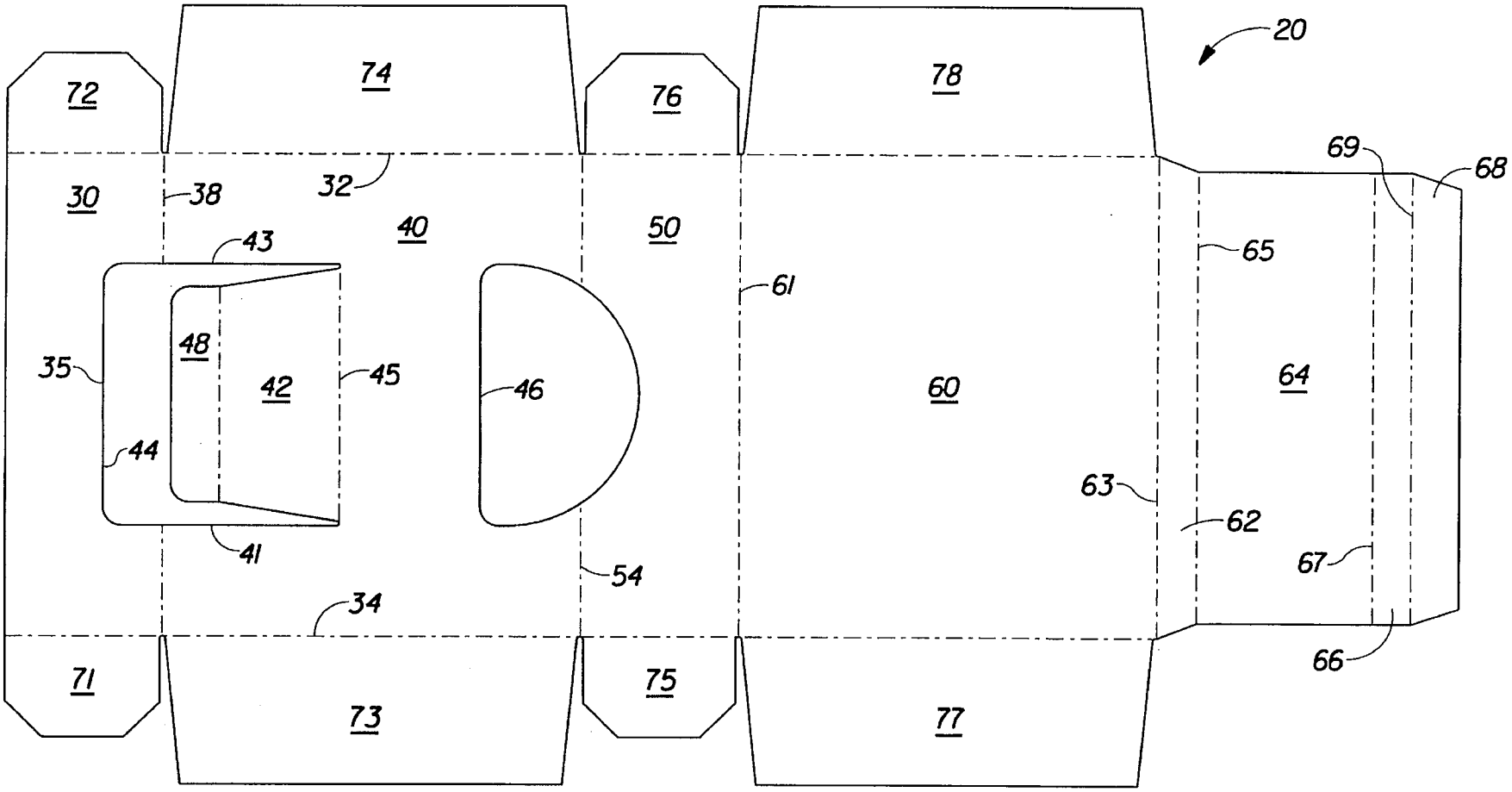
FIG. 4 is a plan view of the blank used to make the carton of FIG. 1.

The embodiment shown in FIG. 1 can readily be made from the blank 20 illustrated in FIG. 4. The blank 20 is cartonboard material and may be, for example, a solid bleached sulfate coated cartonboard. Utilization of a solid bleached sulfate cartonboard provides a material on which a four color printing process can be easily used.

A one piece cartonboard blank 20 for forming a display carton 10 for displaying two articles 120 and 122 in side by side relation having opposing front and back walls 40 and 60, opposing top and bottom walls 80 and 90, and opposing first and second side walls 30 and 50. These walls 30, 40, 50, 60, 80, and 90 are connected forming a box, as shown in FIG. 1. Referring to FIG. 4 the blank 20 incorporates four main walls 30, 40, 50 and 60 which are successively connected to each other along transverse score lines 38, 54, and 61. The four main walls include a first side wall 30, a front wall 40, a second side wall 50 and a back wall 60. The transverse boundaries of each of these walls 30, 40, 50 and 60 are defined by axial score lines 32 and 34. As shown in FIG. 4 the axial score lines 32 and 34 are parallel. The axial score lines 32 and 34 also serve to connect each wall 30, 40, 50 and 60 to an end flap 71 through 78 at each transverse edge.

The end flaps 72, 74, 76 and 78 are associated with a top wall 80 and the end flaps 71, 73, 75 and 77 are associated with a bottom wall 90. Each of the end flaps 73, 74, 77, and 78 preferably have substantially the same transverse dimension as the axial dimension of the first side wall 30 and the second side wall 50. The end flaps 71, 72, 75 and 76 may have a somewhat smaller transverse dimension than the end flaps 73, 74, 77, and 78. Each of the end flaps 71 through 78 have an axial dimension substantially the same as the wall to which the end flap is connected.

Front wall 40 is provided with a cut out aperture 46. This aperture 46 is preferably die cut. The aperture 46 may conform to any shape, for example, circular, elliptical, or rectangular. Spaced axially from the aperture 46 on the front wall 40 are axial cut lines 41 and 43 which may follow any contour. Axial cut lines 41 and 43 are shown in FIG. 4 as being substantially parallel. Axial cut lines 41 and 43 extend from a transverse score line 45 to a transverse cut line 35 defining a compartment dividing wall 42 along with an opening 44 in the front wall 40. Compartment dividing wall 42 is provided with a glue flap 48.

The axial boundaries of back wall 60 are defined by transverse score lines 61 and 63. Transverse score line 63 also serves to connect back wall 60 to glue flap 62. The glue flap 62 is the glue flap of the manufacturers joint. The back side intermediate wall 64 and the compartment wall support 66 successively extend axially from the glue flap 62 and are successively connected to each other along transverse score lines 65 and 67. In this embodiment the compartment wall support 66 is integrally attached to the back intermediate wall 64 along the transverse score line 65. The transverse dimension of glue flap 62, back intermediate wall 64 and compartment wall support 66 is less than the transverse dimension of back wall 60. The back intermediate wall 64 has about the same transverse dimension as the compartment dividing wall 42. The back intermediate wall 64 has about the same transverse dimension as back wall 60 and therefore spans transversely from about the top wall 80 to about the bottom wall 90. This is for the purpose of supporting the first article 120 contained within the first article cell 82. The axial dimensions of glue flap 62 and compartment wall support 66 are substantially equal to each other. Most preferably the axial dimension of glue flap 62 and compartment wall support 66 is substantially equivalent to the axial dimension of the first side wall 30 less the axial dimension of the compartment dividing wall 42. The compartment wall support 66 is provided with a glue flap 68. Glue flap 68 is connected to compartment wall support 66 by transverse score line 69. The axial dimension of back intermediate wall 64 is substantially the same as the axial dimension between transverse score line 38 and transverse score line 45 since the back intermediate wall 64 extends between the first side wall 30 and the compartment dividing wall 42. In this embodiment the axial dimension of the back intermediate wall 64 is greater than the axial dimension of the compartment dividing wall 42.

Preferably all glue flaps are equally sized and have substantially the same width. This is done to minimize material usage and to assist in the folding and gluing process. As such the glue flaps are not considered as double wall thicknesses or as a double thickness of cartonboard material. Alternatively any method known in the art may be utilized to connect the walls of the carton without departing from the teachings of the present invention.

Figure 7:
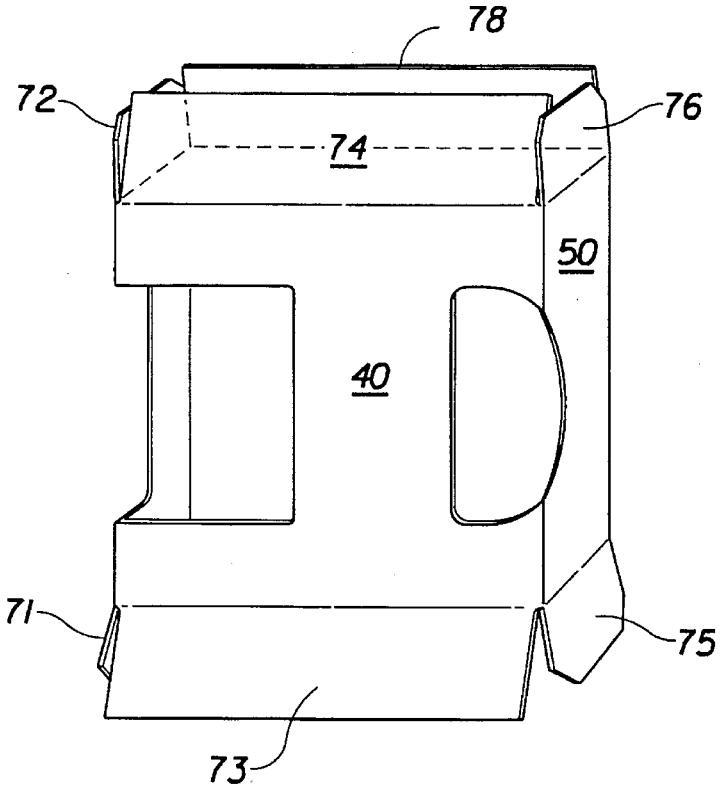
FIG. 7 is a perspective view depicting a sleeve by showing a preferred embodiment of the carton in an intermediate stage of assembly.

To assemble the carton 10, the blank 20 of FIG. 4 is folded and glued forming the sleeve shown in FIG. 7 which has the same cross-section interior plan view as shown in FIG. 2. Initially, a transparent plastic film 47 is adhered to the distal surface of the front wall 40 around the periphery of the aperture 46 such that the transparent plastic film 47 covers the aperture 46 forming an article display window 49. This transparent plastic film 47 is formed of a transparent material, for example, a polyester film. The transparent plastic film 47 is adhered to the front wall 40 using a glue, adhesive, or other similar lamination method well known in the art. The glue flap 68, is then folded 90° downwardly about the transverse score line 69 which connects the glue flap 68 to the compartment wall support 66. Then the compartment wall support 66 is folded 90° downwardly about the transverse score line 67 which connects the compartment wall support 66 to the back intermediate wall 64. The back intermediate wall 64 is folded 90° downwardly about the transverse score line 65 which connects the back intermediate wall 64 to the glue flap 62. Glue is then applied to the glue flap 68. Next the glue flap 62 is folded 90° downwardly about the transverse score line 63 which connects the glue flap 62 to the back wall 60. This fold enables glue flap 68 to come into contact with the distal side of back wall 60 and thereby the glue flap 68 is adhered to the back wall 60. The back wall 60 is then folded 90° downwardly about the transverse score line 61 which connects the back wall 60 to the second side wall 50. Glue flap 48 is folded 90° upwardly such that glue flap 48 is perpendicular to compartment dividing wall 42 and glue is then applied to the glue flap 48. The compartment dividing wall 42 is folded 90° downwardly about the transverse score line 45 which connects the compartment dividing wall 42 to the front wall 40. The second side wall 50 is then folded 90° downwardly about the transverse score line 54 which connects the second side wall 50 to the front wall 40. This fold enables glue flap 48 to come into contact with the back intermediate wall 64 and thereby the glue flap 48 is adhered to the back intermediate wall 64. Glue is then applied to glue flap 62. Next the front wall 40 is then folded 90° downwardly about the transverse score line 38 which connects the front wall 40 to the first side wall 30. This fold enables glue flap 62 to come into contact with the distal side of first side wall 30 and thereby the glue flap 62 is adhered to the first side wall 30. The result of these steps is the sleeve shown in FIG. 7.

When used by the product packer to place articles 120 and 122 into the carton 10, the sleeve shown in FIG. 7 is set on one wall and the articles 120 and 122 are then inserted into the first and second article cells 82 and 84 respectively of the carton 10. After the carton 10 is filled, the end flaps 72, 74, 76 and 78 are folded 90° inward about the axial score line 32. These end flaps 72, 74, 76 and 78 form a top wall 80. The top wall 80 is sealed and closed using, for example, a glue or adhesive. Alternatively, the top wall 80 may be provided with a tuck flap type closure and back wall 60 may be provided with locking cuts to hold the tuck flap in place. The end flaps 71, 73, 75 and 77 are folded 90° inward about the axial score line 34 forming a bottom wall 90. The bottom wall 90 is sealed and closed using, for example, a glue or adhesive. Alternatively, the bottom wall 80 may be provided with a tuck flap type closure and back wall 60 may be provided with locking cuts to hold the tuck flap in place. In a preferred embodiment of the carton 10 only the opposing top and bottom walls 80 and 90 have a double thickness of cartonboard, the remaining walls the first side wall 30, front wall 40, compartment dividing wall 42, second side wall 50, back wall 60, back intermediate wall 64, and compartment wall support 66 all being of a single thickness of cartonboard. Alternatively the walls of the display carton 10 are all of a single thickness of cartonboard. When the carton 10 is set in an upright position all of the vertical walls the first side wall 30, front wall 40, compartment dividing wall 42, second side wall 50, back wall 60, back intermediate wall 64, and compartment wall support 66 have only a single thickness of cartonboard. This configuration minimizes the total amount of cartonboard used in the construction of the carton 10. At this point the display carton 10 for displaying a pair of disparate articles 120 and 122 in side by side relation formed of a one piece blank 20 of cartonboard as shown in FIG. 3, is filled, sealed and ready for shipment.

To open the carton 10 after the top and bottom walls 80 and 90 have been sealed, the user grasps either the top wall 80 or the bottom wall 90. The user then forcibly lifts on the end flaps 72, 74, 76, and 78 of the top wall 80, or forcibly lifts on the end flaps 71, 73, 75, and 77 of the bottom wall 90 thereby forcibly separating these end flaps. The result of this forcible separation is to open the carton 10. After forcibly opening the top wall 80 or the bottom wall 90, the articles 120 and 122 can be removed from the carton 10. Alternatively the user may forcibly separate any walls or portions of any wall or walls thereby fracturing, tearing or otherwise gaining access to the articles 120 and 122 contained within the two article cells 82 and 84 of the carton 10.

A second preferred embodiment is shown in FIG. 5 and FIGS. 8–10. This second embodiment can readily be made from the blank 220 of FIG. 6. In this embodiment The display carton 210 is formed from a one piece blank 220 of cartonboard and contains two disparate articles 320 and 322 in side by side relation. The display carton 210 has opposing front and back walls 240 and 260, opposing top and bottom walls 280 and 290, and opposing first and second side walls 230 and 250. These walls are connected forming a box. Only the opposing top and bottom walls 280 and 290 have a double thickness of cartonboard. The compartment dividing wall 242 is oriented such that it extends from the front wall 240 to the back wall 260. The compartment dividing wall 242 is directly connected to the back wall 260 by a glue flap 248. Similar to the previous embodiment the back intermediate wall 264 extends between the first side wall 230 and the compartment dividing wall 242, however the back intermediate wall 264 has a glue flap 266 that connects the back intermediate wall 264 to the compartment dividing wall 242. The second article cell 284 has a circumference that is defined by four walls. These four walls are the front wall 240, the second side wall 250, the back wall 260, and the compartment dividing wall 242.

Figure 6:
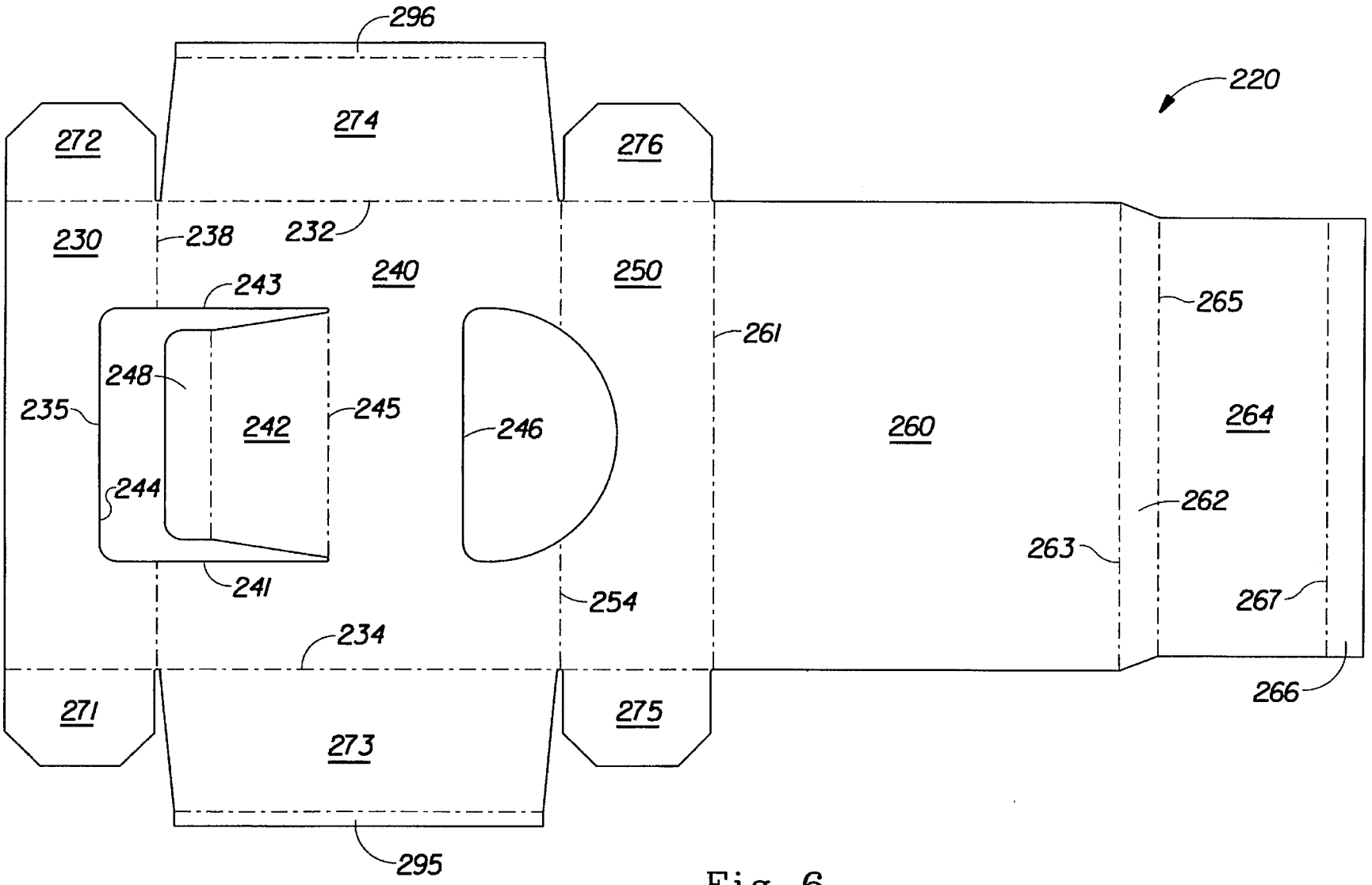
FIG. 6 is a plan view of the blank used to make a second embodiment of the present invention.
Figure 8:
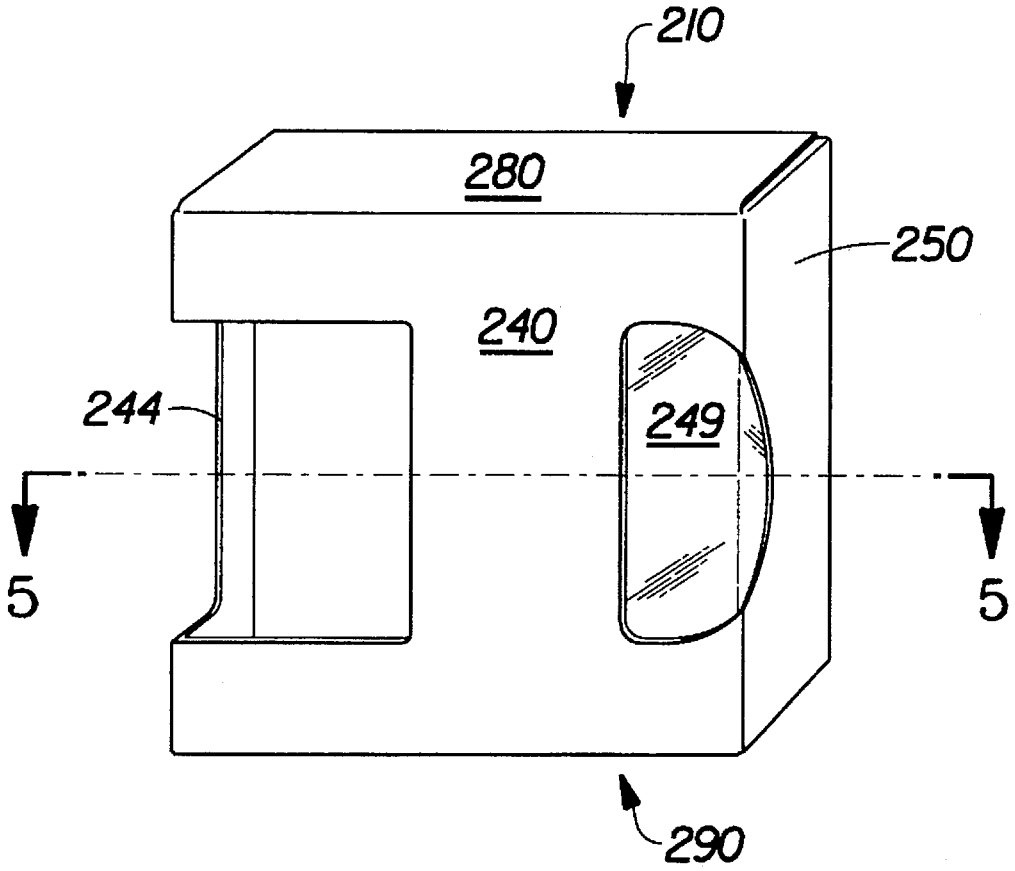
FIG. 8 is a perspective view of a second embodiment of the present invention, without showing the articles contained therein and prior to opening.
Figure 9:
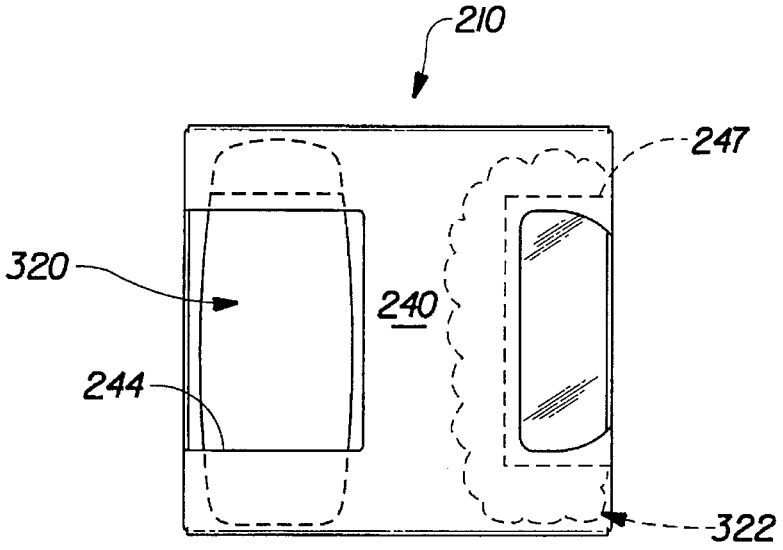
FIG. 9 is a front elevation view of a second embodiment of the present invention showing the articles contained therein, prior to opening.

The blank 220 of FIG. 6 is similar to the blank 20 of FIG. 4. The only differences are that the back wall 260 has no end flaps attached to its transverse edges. The end flaps 273 and 274 have tuck flaps 295 and 296 attached to each transverse edge. The back intermediate wall 264 has a glue flap 266 attached to it by an axial score line 267.

Figure 10:
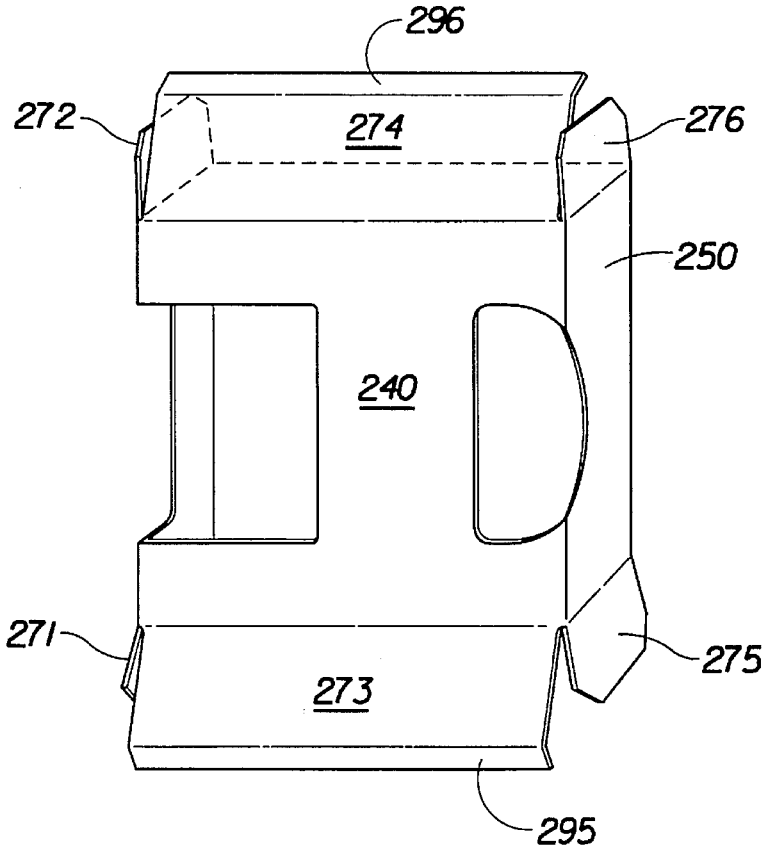
FIG. 10 is a perspective view depicting a sleeve by showing a second embodiment of the carton in an intermediate stage of assembly.

This blank 220 is folded and glued in order to assemble it into the sleeve configuration shown in FIG. 10 in a similar fashion as the previous embodiment. The folding and gluing of the compartment dividing wall 242 and the back intermediate wall 264 requires a slightly different operation than the previous embodiment. The glue flap 266 is folded 90° downwardly about the transverse score line 267 and then glue is applied to this glue flap 266. Next the back intermediate wall 264 is folded similarly to the previous embodiment. The glue flap 248 is folded 90° upwardly such that the glue flap 248 is perpendicular to the compartment dividing wall 242 and glue is then applied to the glue flap 248. The compartment dividing wall 242 is folded 90° downwardly about the transverse score line 245. This fold enables glue flap 248 to come into direct contact with the back wall 260 and thereby the glue flap 248 is adhered to the back wall 260. Thus the compartment dividing wall 242 extends between the back wall 260 and the front wall 240. When the second side wall 250 is folded 90° downwardly about the transverse score line 254, similar to the previous embodiment, this fold enables the glue flap 266 to come into contact with the compartment dividing wall 242 and thereby the glue flap 266 is adhered to the compartment dividing wall 242. The remaining assembly steps are similar to those of the previous embodiment without end flaps 77 and 78 attached to the transverse edges of the back wall 260. The result of these steps, similarly to the previous embodiment, is the sleeve shown in FIG. 10.

Although particular versions and embodiments of the present invention have been shown and described, modification may be made to the carton and the sequence of assembly thereof without departing from the teachings of the present invention. The terms used in describing the invention are used in their descriptive sense and not as terms of limitation, it being intended that all equivalents thereof be included within the scope of the appended claims.

What is claimed is:

1. A display carton for displaying a pair of disparate articles in side by side relation formed from a one piece blank of cartonboard, said display carton comprising:

(a) opposing front and back walls, opposing top and bottom walls, and opposing first and second side walls, said walls connected forming a box wherein only said opposing top and bottom walls have a double thickness of cartonboard;

(b) said front wall having a compartment dividing wall foldably connected thereto and extending inwardly from said front wall to a compartment wall support, said compartment dividing wall separates a first article cell from a second article cell said first article cell having an opening in the front wall and having a back intermediate wall, said back intermediate wall is spaced inwardly from and parallel to said back wall by said compartment wall support, said back wall having an axial boundary defined by a traverse score line said transverse score line connects said back wall to a glue flap, said glue flap is the glue flap of a manufactures joint, wherein said back intermediate wall extends from and is foldably connected to the glue flap of the manufactures joint, said back intermediate wall extends between said first side wall and said compartment dividing wall, said second article cell is provided with an aperture having a transparent plastic film covering said aperture forming an article display window, said article display window enabling a consumer to view an article contained within said second article cell.

2. The display carton of claim 1 wherein said compartment wall support is integrally attached to said back intermediate wall along a score line.

3. The display carton of claim 2 wherein said back intermediate wall has a height substantially equivalent to the height of the first article cell.

4. The display carton of claim 1 wherein said compartment dividing wall extends from the front wall to the back wall.

5. A display carton for displaying a pair of disparate articles in side by side relation formed from a one piece blank of cartonboard, said display carton comprising:

(a) opposing front and back walls, opposing top and bottom walls, and opposing first and second side walls, said walls connected forming a box;

(b) said front wall having a compartment dividing wall foldably connected thereto and extending inwardly from said front wall to a compartment wall support, said compartment wall support and said compartment dividing wall being provided with glue flaps, all of said glue flaps having substantially the same width, said compartment dividing wall being of a single thickness of cartonboard separating a first article cell from a second article cell, said first article cell having an opening in the front wall and having a back intermediate wall, said back intermediate wall being spaced inwardly from and parallel to said back wall by said compartment wall support, said back intermediate wall extending between said first side wall and said compartment dividing wall, said second article cell being provided with an aperture having a transparent plastic film covering said aperture forming an article display window, said article display window enabling a consumer to view an article contained within said second article cell.

6. The display carton of claim 5 wherein said compartment dividing wall has at least one of said glue flaps adhered to said back intermediate wall.

7. The display carton of claim 5 wherein said top wall is provided with a tuck flap.

8. A display carton formed from a one piece blank of cartonboard containing two disparate articles in side by side relation, said display carton comprising:

(a) opposing front and back, walls, opposing top and bottom walls, and opposing first and second side walls, said walls connected forming a box wherein said opposing front and back walls and said opposing first and second side walls have a single thickness of cartonboard;

(b) a first article cell having a circumference defined by said first side wall, said front wall, a compartment dividing wall being of a single thickness of cartonboard, and a back intermediate wall, said front wall having said compartment dividing wall foldably connected thereto and extending inwardly from said front wall to said back intermediate wall, said back intermediate wall being spaced inwardly from and parallel to said back wall by a compartment wall support, said back wall having an axial boundary defined by a traverse score line, said transverse score line connecting said back wall to a glue flap, said glue flap being the glue flap of a manufactures joint, said back intermediate wall extending from and being foldably connected to said glue flap of said manufactures joint, said first article cell having a height, a width, a depth, an opening in said front wall, and a first article contained therein having substantially equivalent height, width and depth;

(c) a second article cell for containing a second article, said second article cell having a circumference defined by said second side wall, said back wall, said compartment wall support, said compartment dividing wall, and said front wall, said second article cell being provided with an aperture having a transparent plastic film covering said aperture forming an article display window, said article display window enabling a consumer to view said second article contained within said second article cell, said second article being resiliently compressible and being maintained in a compressed state by said second article cell.

9. The display carton of claim 8 wherein said second article is a polymeric mesh sponge.

10. The display carton of claim 9 wherein said second article is a cleaning implement.

11. The display carton of claim 9 wherein said first article is a dispensing bottle and said dispensing bottle contains a liquid cleanser for personal use.

12. The display carton of claim 11 wherein said liquid cleanser includes a moisturizer.

13. The display carton of claim 8 wherein said first article is a dispensing bottle.

14. The display carton of claim 13 wherein said dispensing bottle contains a liquid cleanser for personal use.

* * * * *